US005738735A

United States Patent [19]

Bechet

[11] Patent Number: 5,738,735

[45] Date of Patent: Apr. 14, 1998

[54] AL-CU-MG ALLOY WITH HIGH CREEP RESISTANCE

[75] Inventor: Denis Bechet, St. Egreve, France

[73] Assignee: Pechiney Rhenalu, Courbevoie, France

[21] Appl. No.: 686,031

[22] Filed: Jul. 25, 1996

[30] Foreign Application Priority Data

Jul. 28, 1995 [FR] France ..... 95 09443

[51] Int. Cl.[6] ..... C22C 21/00

[52] U.S. Cl. ..... 148/417; 420/533; 420/534; 420/535; 420/537; 420/539; 148/417

[58] Field of Search ..... 420/533, 534, 420/535, 537, 539; 148/417

[56] References Cited

U.S. PATENT DOCUMENTS 5,376,192 12/1994 Cassada ..... 148/417

*Primary Examiner*—David A. Simmons
*Assistant Examiner*—M. Alexandra Elve
*Attorney, Agent, or Firm*—Dennison, Meserole, Pollack & Scheiner

[57] ABSTRACT

A high creep resistance aluminum alloy containing, in percent by weight:

Cu: 2.0–3.0;

Mg: 1.5–2.1;

Mn: 0.3–0.7;

Fe<0.3;

Ni<0.3;

Zr<0.15;

Ti<0.15;

Ag<1.0;

Si<0.6;

with Si and Ag in amounts such that 0.3<Si+0.4Ag<0.6; other elements <0.05 each and <0.15 total; and balance Al. The alloy has in its wrought state after being treated by natural aging, quenching and aging, a creep strain after 1,000 h at 150° C. under a stress of 250 MPA of less than 0.3% and a fracture time of at least 2,500 h, and can be used for structural parts for aircraft or spacecraft, rotating machine parts, or plastic processing molds.

8 Claims, No Drawings

AL-CU-MG ALLOY WITH HIGH CREEP RESISTANCE

BACKGROUND OF THE INVENTION

1. Field of the Invention

The invention relates to aluminum alloys of the 2000 series, as designated by the Aluminum Association of the United States, of the AlCuMg type which, after transformation by extrusion, rolling or forging, have a very low creep strain and a high fracture time at temperatures between 100° and 150° C., while retaining usage properties which are at least equivalent to those of the alloys of this type normally used for similar applications.

2. Description of Related Art

It is has been known for several decades that alloys of the AlCuMgFeNi type have higher creep resistance than AlCuMg alloys with the same Cu and Mg content. First used in the form of cast, die-formed or forged pieces, alloys of this type were adapted for production of high-strength sheet metals and were used, in particular, for the fuselage of the Concorde supersonic aircraft. They correspond to the Aluminum Association designation 2618, and contain the alloying elements (% by weight):

Cu: 1.9–2.7;

Ni: 0.9–1.2;

Mg: 1.3–1.8;

Fe: 0.9–1.3;

Si: 0.10–0.25; and

Ti: 0.04–0.10.

A variant, which can contain up to 0.25% Mn and 0.25% Zr+Ti has also been registered under the designation 2618A.

The alloy 2618, now used for over 20 years, essentially has a creep resistance compatible with the flight conditions of a supersonic aircraft, but its resistance to crack propagation is somewhat insufficient, requiring increased inspection of the fuselage.

For the purpose of preparing a successor to the Concorde, a modification of the alloy 2618 was sought in order to improve its resistance to crack propagation. Thus, French patent FR 2279852 in the name of CEGEDUR PECHINEY proposes an aluminum alloy with a reduced iron and nickel content, which has the following alloying elements (% by weight):

Cu: 1.8–3;

Mg: 1.2–2.7;

Si: <0.3;

Fe: 0.1–0.4; and

Ni and Co, where Ni+Co=0.1–0.4 and (Ni+Co)/Fe: 0.9–1.3.

The alloy can also contain Zr, Mn, Cr, V or Mo contents lower than 0.4%, and possibly Cd, In, Sn or Be contents of at least 0.2% each, a Zn content of at least 8% or an Ag content of at least 1%. This alloy results in a substantial improvement in the stress concentration factor $K_{1c}$ which represents resistance to crack propagation. Conversely, the results of creep tests at temperatures of 100° and 175° C. are entirely comparable to those of AA2618.

SUMMARY OF THE INVENTION

Within the scope of the development of a new supersonic civil aircraft whose speed and operating conditions will result in a higher skin temperature for the fuselage, but also for other applications such as plastic processing molds, aircraft wheels or de-icing structures or rotating machine parts, it appeared to be necessary to use an alloy having a higher creep resistance than the alloys of the prior art, that is, an extremely low total strain under stress between 100° and 150° C. for a period longer than 60,000 hours, and a limitation of the creep damage which can cause the onset of fatigue cracking, which translates into a high fracture time, without of course causing any deterioration of the other usage properties such as the static mechanical properties or corrosion resistance.

Thus, the subject of the invention is an AlCuMg alloy which makes it possible to obtain, in a product wrought by extrusion, rolling or forging, a creep strain after 1,000 hours at 150° C. under a stress of 250 MPa of less than 0.3% and a fracture time of at least 2,500 hours, and which has a composition of (% by weight):

Cu: 2.0–3.0;

Mg. 1.5–2.1;

Mn: 0.3–0.7;

Zr <0.15;

Si: 0.3–0.6;

Fe: <0.3;

Ni: <0.3;

Ti: <0.15;

other elements: <0.05 each and 0.15 total; and balance Al.

The alloy can also include a silver content of less than 1%, and in this case, this element can partially substitute for the silicon; the total Si+0.4Ag must be between 0.3 and 0.6%. Preferably, the Cu content is between 2.5 and 2.75% and the Mg content is between 1.55 and 1.8%.

DETAILED DESCRIPTION OF THE INVENTION

The alloy according to the invention is distinguished from that described in French patent FR 2279852 by even further reduced iron and nickel contents and by a higher silicon content. The iron and the nickel are kept below 0.3% instead of 0.4%, and it is even possible to completely eliminate the nickel, which offers a distinct advantage in the recycling of manufacturing wastes composed of conventional remelted alloys.

This reduction was not suggested in the prior art. Thus, D. ADENIS and R. DEVELAY studied the influence of iron and nickel on creep resistance in the article "The relationship between creep resistance and the microstructure of AU2GN" which appeared in the Scientific Papers of the Metallurgy Review, No. 10, 1969, and they showed that the creep resistance at 150° C. of an alloy without Fe and Ni was not as good as that of 2618. The same article also studied the role of silicon and it showed that the creep resistance is optimal with a silicon content of 0.25%.

Likewise, studies conducted at the ONERA by H. MARTINOD and J. CALVET on the alloy 2618 ("On the heat stability of refractory aluminum alloys of the AU2GN type," ONERA study, 1961) concluded that a silicon content between 0.15 and 0.25% is the most well-suited even for extended use at 200° C., and that increasing the silicon content up to 0.5% does not result in any improvement. On the other hand, the metallurgical role of the silicon, which is present in the structure in the form of a solid solution or an $Mg_2Si$ precipitate, does not seem to be necessarily different for AA2618 than for an alloy with a low iron and nickel content. Thus, increasing the silicon content to values on the order of 0.5% was not in any way suggested by the literature on the subject or by metallurgical reasoning.

The favorable role of silver in the creep resistance of AlCuMg alloys has been known for many years, particularly for casting alloys, and it has been the object of metallurgical studies, for example the work of I. J. POLMEAR and M. J. COUPER "Design and development of an experimental wrought aluminum alloy for use at elevated temperatures," Metallurgical Transactions A, Vol. 19A, April 1988, pp. 1027–1035.

Applicant has determined that silicon can be replaced by a quantity of silver 2.5 times greater, which, considering the cost of this metal, does not have much of an economic advantage. Moreover, applicant has determined that, surprisingly, the simultaneous addition of silicon and silver in contents such that Si+0.4Ag is greater than 0.6% has an unfavorable influence on creep resistance, particularly on the fracture time.

The alloy according to the invention has a manganese content between 0.3 and 0.7%. The manganese contributes to an increase in the mechanical properties. The alloy 2618 does not contain manganese (H. MARTINOD mentions in his article a content of 0.014% in an example of an industrial alloy), no doubt so as not to interfere with the formation of the intermetallic iron and nickel compounds $Al_9FeNi$. It is probably for the same reason that French patent FR 2279852, while mentioning the possibility of a manganese addition of up to 0.4% as one of 11 optional alloying elements, does not give any example of a composition containing manganese. This addition, up to a content of 0.7% beyond which harmful precipitates appear, is made possible by the limitation of the iron and nickel, and it corresponds to that of the high-strength alloy 2024 used for the fuselages of subsonic aircraft.

The combination of these various modifications, namely the limitation of the iron and nickel, the increase in the silicon content and the presence of manganese, leads to an unexpected increase in creep resistance relative to the alloy 2618 and to an alloy such as that described in French patent FR 2279852. Thus, in tests on light sheet metals with a thickness of 1.6 mm, for a duration of 1,000 hours under a stress of 250 MPa at a temperature of 150° C., the results were a strain at 1,000 hours of less than 0.3% instead of 1%, a secondary creep rate of less than $10^{-9}$ $s^{-1}$ instead of $2.5\times10^{-9}$ $s^{-1}$ and a fracture time greater than 2,500 hours instead of less than 1,500 hours. Note that the fine grained recrystallized structure of light sheet metals represents the most unfavorable condition for creep resistance, particularly for strain under stress, due to the localized strain at the grain boundaries.

This last result is particularly interesting, although it has rarely been taken into account in previous studies on the creep of aluminum alloys. In fact, in the case of a structural part which is subject to cyclic stresses, it is important not only for the creep strain to be low, but for the fracture to occur as late as possible. This delays the entry of the strain-time creep curve into the so-called "tertiary" phase, that is the phase in which the slope of the curve starts to increase and in which the fracture begins, with the appearance of creep cracks at this temperature leading to low fatigue strength.

The toughness of the alloys according to the invention is entirely similar to that mentioned in French patent FR 2279852, which is to say that it represents, for the stress concentration coefficient $K_{1c}$, a gain of 20 to 40% relative to the alloy 2618.

The alloys according to the invention can be cast in the form of billets or plates by the standard processes for casting alloys of the 2000 series, and transformed by extrusion, hot rolling and possibly cold rolling, die-forming or forging, and the semi-finished product thus obtained is usually heat treated by natural aging, quenching and possibly controlled stretching in order to reduce the residual stress and aging in order to give it the mechanical properties required for the proposed application.

EXAMPLES

Example 1

Plates were cast using the alloy 2618, the alloy A according to French patent FR 2279852, 4 alloys B, C, D and E according to the invention, and 3 alloys F, G, H outside the invention. The chemical compositions of the alloys are given in Table 1. The alloy A, unlike the alloys exemplified in the patent, contains manganese, which allows the role of the other elements, particularly the silicon, to be more clearly distinguished by comparison. The alloys B, D and E contain silver. The alloy E is in conformity with the invention, but its Mg content is outside the preferred range. The alloy F is just below the bottom limit for the sum Si+0.4Ag and is also outside the preferred range for Mg. The alloy G is slightly above the top limit for Si+0.4Ag and the alloy H is outside the limits for Cu.

The plates were then homogenized for 24 hours at 520° C., hot rolled, then cold rolled to a thickness of 1.6 mm, having a fine grained recrystallized metallurgic structure after a natural aging for 40 min at 530° C., a controlled stretching to 1.4% strain, quenching and aging for 19 hours at 190° C.

Creep tests were carried out in accordance with the ASTM E 139 standard, and measurements were taken, under a stress of 250 MPa and at a temperature of 150° C., of the strain after 1,000 hours, the minimum creep rate, that is the slope of the creep strain curve as a function of time in the secondary creep zone, and the fracture time, which represents the resistance to damage. The results are given in Table 2.

It is noted that the alloys according to the invention all have a creep strain at 1,000 hours of less than 0.30%, a minimum creep rate of less than $0.6\times10^{-9}$ per second and a fracture time greater than 2,500 hours, whereas these values for AA2618 and for the alloy according to FR 2279852 with an addition of manganese are, respectively, on the order of 0.9 to 1%, $2.5\times10^{-9}$ $s^{-1}$ and 1,400 hours.

The critical nature of the limit of the sum Si+0.4Ag is also noted, as the strain and the fracture time are extremely reduced above the top limit of 0.6%. The advantages of the preferred ranges of composition for Cu and Mg are also evident.

Example 2

Plates were cast using the alloy 2618, the alloy A of the preceding example, and 3 other alloys according to the invention I, J and K, the chemical compositions of which are provided in Table 3. These alloys do not contain silver and the alloy J does not contain any nickel at all. The alloys I and J have a manganese content near the bottom limit of the range, while the alloy K is near the top limit.

The plates were homogenized for 24 hours at 520° C., scalped and hot rolled to a thickness of 14 mm. Some of the sheets obtained were left at this thickness, and others were cold rolled to 1.6 mm. The sheets were aged at 530° C.—the 14 mm sheets for 1 hour and the 1.6 mm sheets for 40 min.—then stretched, quenched and aged for 19 hours at 190° C.

The 0.2% yield strength $R_{0.2}$, the fracture stress $R_m$ and the creep elongation A of these sheets were measured. These results are indicated in Table 4. They show that the yield strength and the fracture stress are practically the same for all 5 alloys, and that the elongation of the sheets made from the alloys according to the invention is slightly greater than that of the sheets made from AA2618 or from the alloy A.

The minimum creep rate was then measured at 150° C. (for the 1.6 mm sheets only) and at 175° C. under 250 MPa, as in the preceding example. The results are indicated in Table 5, which shows quite a substantial improvement in the creep resistance of the alloys according to the invention relative to those of the prior art, particularly at 175° C. Finally, the toughness of the sheets made from the alloys according to the invention (about 125 MPavm for the 1.6 mm thickness) is entirely comparable to that of the alloy A.

TABLE 1

| ALLOY | Cu | Mg | Fe | Ni | Ti | Si | Mn | Zr | Ag |
|---|---|---|---|---|---|---|---|---|---|
| 2618 | 2.59 | 1.60 | 1.04 | 1.04 | 0.08 | 0.22 | 0.09 | — | — |
| A | 2.71 | 1.64 | 0.20 | 0.21 | 0.10 | 0.21 | 0.34 | — | — |
| B | 2.65 | 1.57 | 0.21 | 0.17 | 0.10 | 0.23 | 0.36 | 0.04 | 0.46 |
| C | 2.70 | 1.65 | 0.20 | 0.20 | 0.10 | 0.50 | 0.35 | — | — |
| D | 2.70 | 1.65 | 0.20 | 0.20 | 0.10 | 0.10 | 0.35 | — | — |
| E | 2.70 | 2.00 | 0.20 | 0.20 | 0.10 | 0.10 | 0.35 | — | — |
| F | 2.70 | 2.00 | 0.20 | 0.20 | 0.10 | 0.10 | 0.35 | — | 0.5 |
| G | 2.70 | 1.65 | 0.20 | 0.20 | 0.10 | 0.50 | 0.35 | — | 0.5 |
| H | 3.00 | 1.65 | 0.20 | 0.20 | 0.10 | 0.20 | 0.35 | — | 0.5 |

TABLE 2

| ALLOY | STRAIN 1000 h % | MIN. CREEP RATE $10^{-9}$ $s^{-1}$ | FRACTURE TIME h |
|---|---|---|---|
| 2618 | 0.88 | 2.4 | 1350 |
| A | 1.08 | 2.5 | 1400 |
| B | 0.20 | 0.28 | >3800 |
| C | 0.14 | 0.21 | 7700 |
| D | 0.10 | 0.31 | >5000 |
| E | 0.24 | 0.57 | 2500 |
| F | 0.81 | 0.62 | 1000 |
| G | 0.10 | 0.52 | 2200 |
| H | 0.78 | 0.90 | 1100 |

TABLE 3

| ALLOY | Cu | Mg | Fe | Ni | Ti | Si | Mn | Zr | Ag |
|---|---|---|---|---|---|---|---|---|---|
| I | 2.70 | 1.65 | 0.20 | 0.2 | 0.1 | 0.4 | 0.35 | — | — |
| J | 2.70 | 1.65 | 0.10 | — | 0.1 | 0.4 | 0.35 | — | — |
| K | 2.70 | 1.54 | 0.20 | 0.2 | 0.1 | 0.5 | 0.60 | — | — |

TABLE 4

| ALLOY | THICKNESS (mm) | R0.2 (MPa) | Rm (MPa) | A % |
|---|---|---|---|---|
| 2618 | 1.6 | 403 | 440 | 7 |
| A | " | 415 | 450 | 9.5 |
| I | " | 428 | 456 | 10.3 |
| J | " | 426 | 456 | 10.6 |
| K | " | 423 | 460 | 10.5 |
| 2618 | 14 | 416 | 455 | 5.5 |
| A | " | 415 | 450 | 10.5 |
| I | " | 411 | 452 | 11.7 |
| J | " | 414 | 453 | 11.7 |
| K | " | 423 | 451 | 12.8 |

TABLE 5

| ALLOY | THICKNESS (mm) | CREEP TEST - 150° C. - 250 MPa Rate ($10^{-9}$ $s^{-1}$) | CREEP TEST - 150° C. - 250 MPa Fracture time (h) | CREEP TEST - 175° C. - 250 MPA Rate ($10^{-9}$ $s^{-1}$) | CREEP TEST - 175° C. - 250 MPA Fracture time (h) |
|---|---|---|---|---|---|
| 2618 | 1.6 | 2.4 | 1350 | 60 | 86 |
| A | " | 2.5 | 1400 | 65 | 70 |
| I | " | 0.55 | >3000 | 2.1 | 412 |
| J | " | 0.4 | >3000 | 2.1 | 514 |
| K | " | 0.5 | >3000 | 1.5 | 345 |
| 2618 | 14 | | | 41 | 110 |
| A | " | | | 40 | 110 |
| I | " | | | 1.8 | 422 |
| J | " | | | 1.6 | 393 |
| K | " | | | 1.1 | 528 |

What is claimed is:

1. A high creep resistance aluminum alloy consisting essentially of, in percent by weight:

Cu: 2.0–3.0;

Mg: 1.5–2.1;

Mn: 0.3–0.7;

Fe<0.3;

Ni<0.3;

Zr<0.15;

Ti<0.15;

Ag<1.0;

Si:0.3–0.6;

with Si and Ag in amounts such that 0.3<Si+0.4Ag<0.6; other elements <0.05 each and <0.15 total; and balance Al.

2. The alloy according to claim 1, containing 2.5 to 2.75% by weight Cu.

3. The alloy according to claim 1, containing 1.55 to 1.8% Mg.

4. The alloy according to claim 1, which is wrought by extrusion.

5. The alloy according to claim 1, which is wrought by forging.

6. The alloy according to claim 1, which is wrought by rolling.

7. The alloy according to claim 2, containing 1.55 to 1.8% Mg.

8. The alloy according to claim 1 in a wrought state after treatment by natural aging, quenching and aging, said alloy having a creep strain after 1,000 h at 150° C. under 250 MPA of less than 0.3% and a fracture time of at least 2,500 h.

* * * * *